US009279228B1

(12) United States Patent
Jinnings

(10) Patent No.: US 9,279,228 B1
(45) Date of Patent: Mar. 8, 2016

(54) PULL-OUT RESISTANT PILES

(71) Applicant: Hercules Machinery Corporation, Fort Wayne, IN (US)

(72) Inventor: John W. Jinnings, Leo, IN (US)

( * ) Notice: Subject to any disclaimer, the term of this patent is extended or adjusted under 35 U.S.C. 154(b) by 0 days.

(21) Appl. No.: 14/208,391

(22) Filed: Mar. 13, 2014

Related U.S. Application Data

(60) Provisional application No. 61/782,178, filed on Mar. 14, 2013.

(51) Int. Cl.
*E02D 5/54* (2006.01)
*E02D 7/26* (2006.01)
*E02D 7/02* (2006.01)

(52) U.S. Cl.
CPC .. *E02D 5/54* (2013.01); *E02D 7/02* (2013.01); *E02D 7/26* (2013.01)

(58) Field of Classification Search
CPC ..... E02D 5/54; E02D 5/803; E02D 5/80
USPC ..... 405/231, 232, 244
See application file for complete search history.

(56) References Cited

U.S. PATENT DOCUMENTS

| | | | | | |
|---|---|---|---|---|---|
| 856,003 | A | * | 6/1907 | Thomas | 52/162 |
| 1,695,523 | A | * | 12/1928 | Bilhorn | 52/164 |
| 1,762,341 | A | * | 6/1930 | McPherson | 405/256 |
| 1,982,687 | A | * | 12/1934 | O'Brien | 405/257 |
| 3,335,596 | A | | 8/1967 | Noda et al. | |
| 3,479,829 | A | * | 11/1969 | Goodman | 405/238 |
| 3,796,056 | A | | 3/1974 | Dougherty | |
| 3,995,438 | A | | 12/1976 | Pogonowski | |
| 4,733,994 | A | * | 3/1988 | Simanjuntak | 405/244 |
| 4,836,716 | A | | 6/1989 | Spalding et al. | |
| 5,028,166 | A | | 7/1991 | Leishman | |
| 5,533,356 | A | | 7/1996 | DeMasters | |
| 5,639,184 | A | | 6/1997 | DeMasters | |
| 5,642,964 | A | | 7/1997 | DeMasters | |
| 7,556,454 | B2 | | 7/2009 | Cable et al. | |
| 7,901,173 | B2 | | 3/2011 | Spilker | |
| 8,162,583 | B2 | | 4/2012 | Spilker | |

FOREIGN PATENT DOCUMENTS

| | | |
|---|---|---|
| JP | 3036315 | 2/1991 |
| JP | 3690247 | 8/2005 |
| KR | 2006-0110611 | 10/2006 |

* cited by examiner

*Primary Examiner* — Tara M. Pinnock
(74) *Attorney, Agent, or Firm* — Faegre Baker Daniels LLP

(57) ABSTRACT

A pile is disclosed for insertion by a pile driver. The pile incorporates transversely extending anchors for increased pull-out resistance.

6 Claims, 5 Drawing Sheets

PULL-OUT RESISTANT PILES

CROSS REFERENCE TO RELATED APPLICATION

This application claims the benefit of U.S. Provisional Application No. 61/782,178, filed Mar. 14, 2013, entitled PULL-OUT RESISTANT PILES, the entire disclosure of which is hereby expressly incorporated herein by reference.

FIELD OF THE DISCLOSURE

The present disclosure relates to piles. More particularly, the present disclosure relates to piles having anchors for increased pull-out resistance, and to a method for using the same.

BACKGROUND OF THE DISCLOSURE

Piles are used to transfer a structural load to the soil below the ground surface. Piles may driven into the soil using a vibratory pile driver, for example. Vibratory pile drivers include a large, heavy housing clamped to the upper end of the pile to be driven. The housing may be provided with at least two eccentric weights. The eccentric weights are rotated at high speed to vibrate the housing. The vibration of the housing, coupled with the weight of the housing, causes the pile to sink into the soil below the ground surface. In alternative configurations, the articulated boom of an excavator may be used to drive the pile downward into the soil as it vibrates. Piles may also be impacted or otherwise driven into the soil.

SUMMARY

The present disclosure provides a pile adapted for insertion by a pile driver. The pile of the present disclosure incorporates transversely extending anchors for increased pull-out resistance.

According to an embodiment of the present disclosure, a pile is provided having an upper end, a lower end, and a longitudinal axis that extends between the upper end and the lower end, a longitudinal plane intersecting and extending parallel to the longitudinal axis. The pile includes a first longitudinal wall located on a first side of the longitudinal plane, a second longitudinal wall located on a second side of the longitudinal plane, an interior space formed between the first and second longitudinal walls, and at least one anchor located at least partially in the interior space between the first and second longitudinal walls, the anchor extending transversely to the longitudinal axis.

According to another embodiment of the present disclosure, a pile is provided having an upper end, a lower end, and a longitudinal axis that extends between the upper end and the lower end, a longitudinal plane intersecting and extending parallel to the longitudinal axis, a perpendicular plane extending perpendicular to the longitudinal axis. The pile includes a first longitudinal wall located on a first side of the longitudinal plane, a second longitudinal wall located on a second side of the longitudinal plane, an interior space formed between the first and second longitudinal walls, the interior space having a total area measured in a direction perpendicular to the longitudinal axis, and at least one anchor in the interior space, the at least one anchor having a projected area on the perpendicular plane, the projected area of the at least one anchor comprising a majority of the total area of the interior space.

According to yet another embodiment of the present disclosure, a method is provided for driving a pile into soil beneath a ground surface. The method includes the steps of coupling a pile driver to a pile, the pile having an upper end, a lower end, a longitudinal axis that extends between the upper end and the lower end, and at least one anchor that extends from the pile in a direction transverse to the longitudinal axis, and driving the lower end of the pile into soil with the pile driver.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
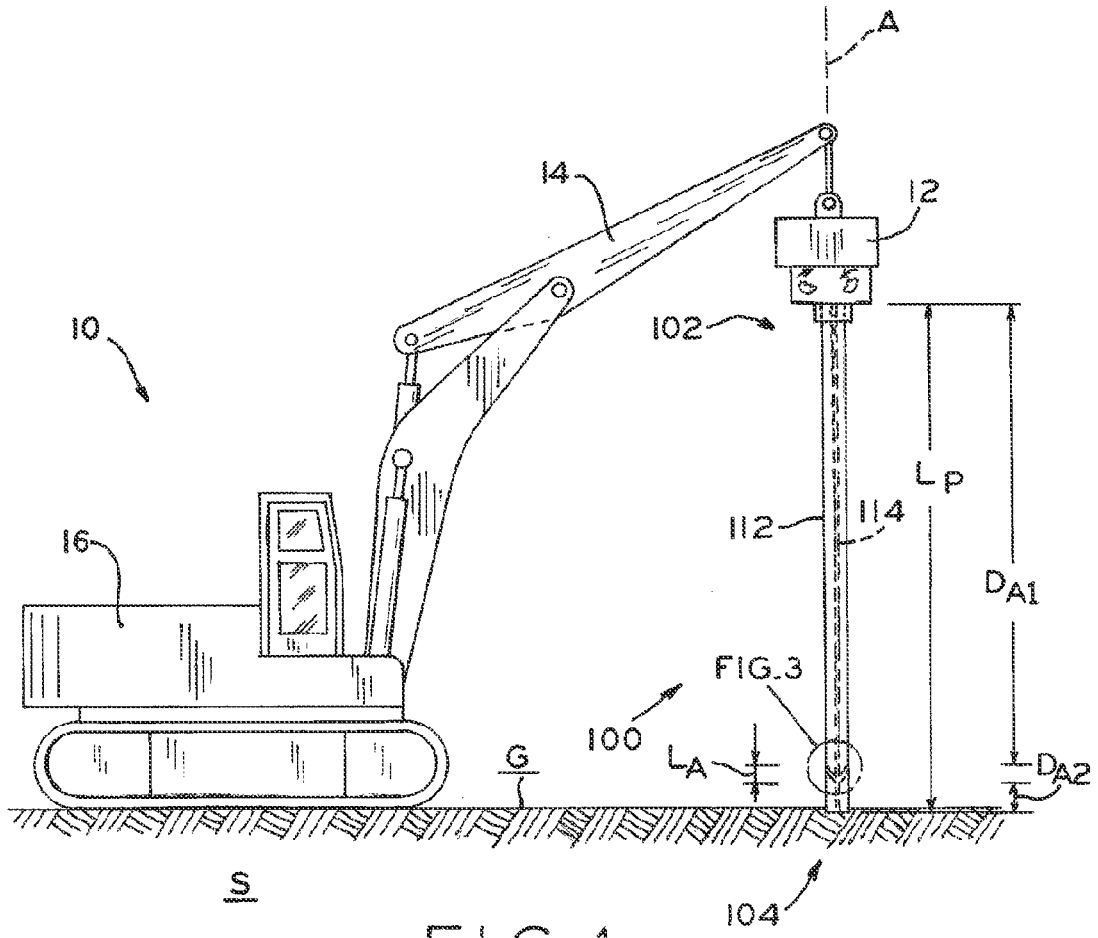
FIG. 1 is an elevational view of an exemplary pile of the present disclosure shown coupled to a vibratory pile driver before being inserted into the soil.

A pile driver 10 is shown in FIG. 1 for driving a pile 100 into the soil S below the ground surface G. Pile 100 includes upper end 102, lower end 104, and longitudinal axis A that extends between upper end 102 and lower end 104. The illustrative pile driver 10 is a vibratory pile driver including a vibratory housing 12 coupled to an articulating boom 14 of an excavator 16 and to upper end 102 of pile 100. Pile driver 10 may also be configured to impact or otherwise drive pile 100 into the soil S.

Figure 2A:
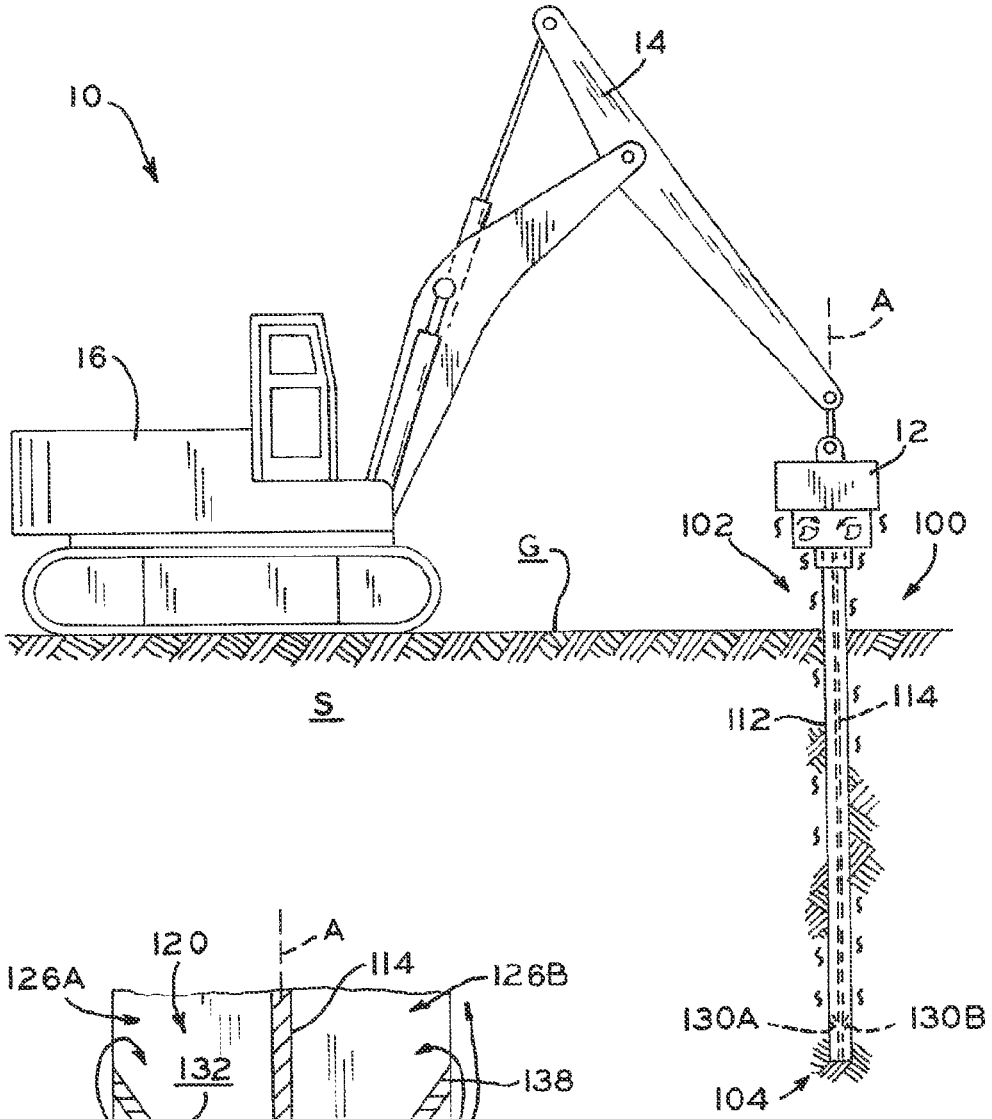
FIG. 2A is another elevational view showing the pile of FIG. 1 being vibrated by the vibratory pile driver and driven into the soil.

Referring next to FIG. 2A, the vibration of housing 12, coupled with the weight of housing 12 atop pile 100, causes pile 100 to travel downward into the soil S along longitudinal axis A. The articulating boom 14 may articulate relative to excavator 16 to guide housing 12 and pile 100 downward. When pile 100 vibrates in the soil S, particle-to-particle adhesion between the soil particles decreases, and the soil S becomes more flowable (i.e., quick-conditioned) to accommodate passage of pile 100. Upper end 102 of pile 100 approaches the ground surface G, and lower end 104 of pile 100 sinks into the soil S below the ground surface G. When pile 100 stops vibrating in the soil S, particle-to-particle adhesion between the soil particles returns to hold pile 100 in place.

Figure 3:
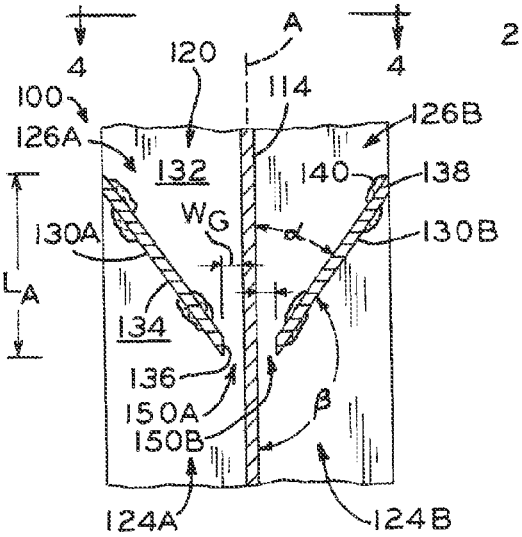
FIG. 3 is an elevational cross-sectional view of a lower portion of the pile of FIG. 1, which is circled in FIG. 1.
Figure 4:
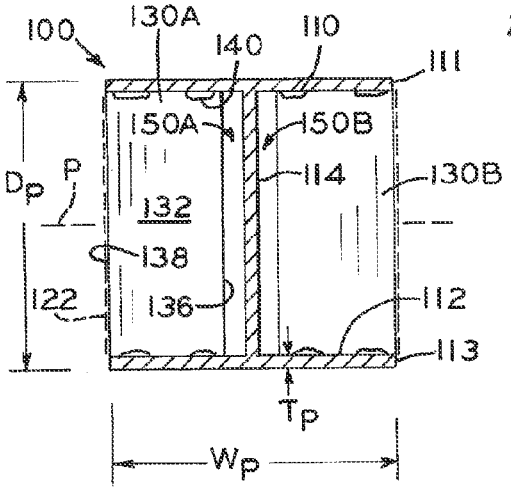
FIG. 4 is a plan cross-sectional view of the pile of FIG. 3, taken along line 4-4 of FIG. 3.

A first exemplary pile 100 is shown in more detail in FIGS. 3 and 4. The illustrative pile 100 is an H-pile having an H-shape when viewed in plan or cross-section, as shown in FIG. 4. Pile 100 includes a first exterior flange 110, a second exterior flange 112 that is oriented substantially parallel to the first flange 110, and an intermediate web 114 that extends between the first and second flanges 110, 112, in a direction substantially orthogonal to the first and second flanges 110, 112.

The material used to construct pile 100 may vary depending on the desired application of pile 100 (e.g., the load to be supported by pile 100, the surrounding soil type). For example, pile 100 may be constructed of metal (e.g., aluminum), a metal alloy (e.g., hardened or mild steel), or another suitable material.

The dimensions of pile 100 may vary depending on the desired application of pile 100 (e.g., the load to be supported by pile 100, the surrounding soil type). Pile 100 may have a width $W_P$ (measured along first and second flanges 110, 112 in FIG. 4) and a depth $D_P$ (measured along intermediate web 114 in FIG. 4) as small as about 4 in., 6 in., or 8 in., and as large as about 10 in., 12 in., 14 in., or more, or within any range defined between any pair of the foregoing values. Pile 100 may be substantially square-shaped, such that the pile width $W_P$ is substantially equal to the pile depth $D_P$. Also, first and second flanges 110, 112, and intermediate web 114 of pile 100 may have a pile wall thickness $T_P$ as small as about ⅛ in., ¼ in., or ⅜ in., and as large as about ½ in., ⅝ in., ¾ in., or more, or within any range defined between any pair of the foregoing values. As shown in FIG. 1, pile 100 may have an overall length $L_P$ (measured along longitudinal axis A) as small as about 20 ft., 40 ft., or 60 ft., and as large as about 80 ft., 100 ft., or more, or within any range defined between any pair of the foregoing values.

According to an exemplary embodiment of the present disclosure, pile 100 is at least partially hollow. In general, the hollow interior space is defined between a first longitudinal wall located on a first side of a longitudinal plane (i.e., a plane that intersects and extends parallel to a longitudinal axis) and a second longitudinal wall located on a second side of the longitudinal plane. In the illustrated embodiment of FIGS. 3 and 4, for example, first flange 110 constitutes the first longitudinal wall located on a first side of longitudinal plane P (i.e., a plane that intersects and extends parallel to longitudinal axis A), and second flange 112 constitutes the second longitudinal wall located on a second side of longitudinal plane P. First and second flanges 110, 112, are the outer-most or exterior-most longitudinal walls of the illustrative pile 100. Also, as shown in FIG. 4, longitudinal plane P is a plane of symmetry through the illustrative pile 100.

When the illustrative pile 100 is viewed along longitudinal axis A, as shown in FIG. 4, the first and second longitudinal walls, specifically the first and second flanges 110, 112, are seen creating an envelope 122 around interior space 120. In embodiments where first and second flanges 110, 112, do not extend to or intersect longitudinal plane P, envelope 122 around interior space 120 may be formed by projecting the ends 111, 113, of first and second flanges 110, 112, respectively, onto longitudinal plane P, as shown in FIG. 4. By contrast, in embodiments where first and second flanges 110, 112, bend or curve to intersect longitudinal plane P, envelope 122 around interior space 120 may be formed by first and second flanges 110, 112, themselves.

In FIG. 4, intermediate web 114 is shown extending through interior space 120 between first and second flanges 110, 112, of the illustrative pile 100. More specifically, intermediate web 114 is shown bisecting interior space 120 of the illustrative pile 100. Intermediate web 114 may occupy a minority (i.e., less than 50%) of the cross-sectional area of interior space 120. For example, intermediate web 114 may occupy less than about 20%, 15%, 10%, or 5%, of the cross-sectional area of interior space 120, or within any range defined between any pair of the foregoing values.

Figure 2B:
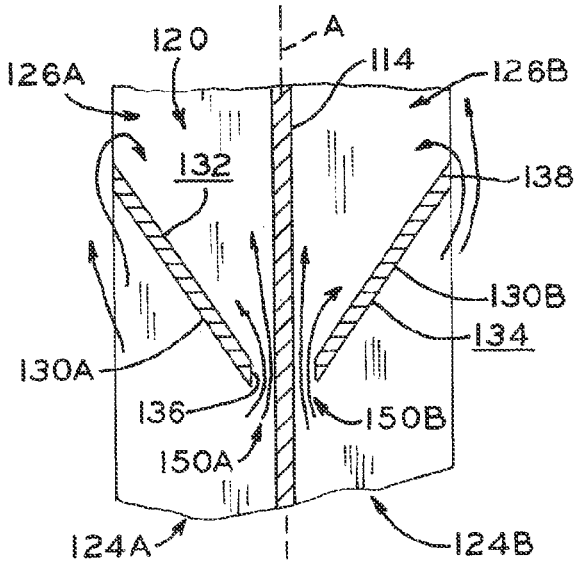
FIG. 2B is an elevational cross-sectional view of a lower portion of the pile of FIG. 2A.

According to another exemplary embodiment of the present disclosure, pile 100 is open-ended to the hollow interior space, at least along its lower end. In the illustrated embodiment of FIG. 2A, for example, pile 100 is open-ended to interior space 120 by virtue of lower end openings 124A, 124B, in lower end 104 that make interior space 120 open or accessible along lower end 104. Lower end openings 124A, 124B, are located on opposite sides of intermediate web 114. In use, soil S is able to enter interior space 120 of pile 100 through lower end openings 124A, 124B, in lower end 104. The illustrative pile 100 also includes side openings 126A, 126B, into interior space 120, so in addition to entering interior space 120 through lower end openings 124A, 124B, soil S may also enter interior space 120 through side openings 126A, 126B, as shown in FIG. 2B. Side openings 126A, 126B, are located on opposite sides of intermediate web 114.

Referring again to FIGS. 3 and 4, the illustrative pile 100 includes one or more anchors, illustratively two anchors 130A, 130B. Anchors 130A, 130B, of the illustrative pile 100 are located on opposite sides of intermediate web 114. Anchors 130A, 130B, of the illustrative pile 100 are mirror images of one another. Each anchor 130A, 130B, includes a generally planar upper surface 132, a generally planar lower surface 134, an interior side 136 located adjacent to longitudinal axis A, and an exterior side 138. In use, anchors 130A, 130B, may resist removal of pile 100 from the soil S, as discussed further below.

Anchors 130A, 130B, are located between upper end 102 and lower end 104 of the illustrative pile 100, as shown in FIG. 1. Anchors 130A, 130B, may be spaced apart from upper end 102 of pile 100 by a longitudinal distance $D_{A1}$ and from lower end 104 of pile 100 by a longitudinal distance $D_{A2}$. More specifically, anchors 130A, 130B, may be spaced apart further from upper end 102 than lower end 104, such that distance $D_{A1}$ to upper end 102 of pile 100 exceeds distance $D_{A2}$ to lower end 104 of pile 100. For example, distance $D_{A1}$ to upper end 102 of pile 100 may be about 4 times, 6 times, 8 times, 10 times, or more greater than distance $D_{A2}$ to lower end 104 of pile 100.

Anchors 130A, 130B, occupy a longitudinal extent of the illustrative pile 100 having a length $L_A$, as shown in FIG. 1. The length $L_A$ occupied by anchors 130A, 130B, may comprise a small percentage of the overall length $L_P$ of pile 100. For example, length $L_A$ occupied by anchors 130A, 130B, may comprise less than about 10%, 5%, 1%, or 0.5%, of the overall length $L_P$ of pile 100, or within any range defined between any pair of the foregoing values.

Figure 5:
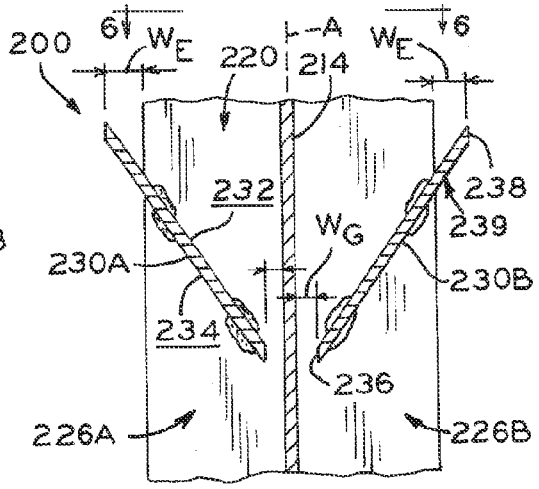
FIG. 5 is an elevational cross-sectional view of a lower portion of another exemplary pile of the present disclosure.
Figure 6:
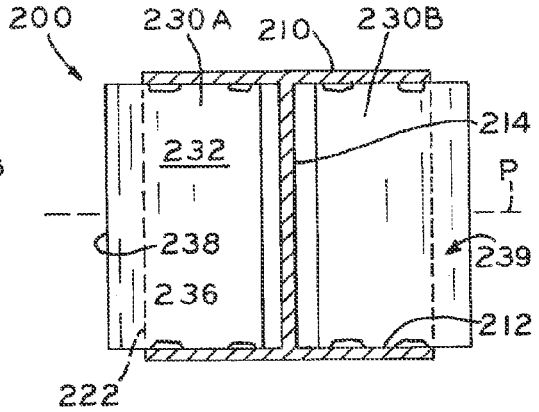
FIG. 6 is a plan cross-sectional view of the pile of FIG. 5, taken along line 6-6 of FIG. 5.

Anchors 130A, 130B, are located at least partially within interior space 120 of the illustrative pile 100. In FIGS. 3 and 4, anchors 130A, 130B, are located entirely within interior space 120 of pile 100 without projecting beyond envelope 122. In FIGS. 5 and 6, by contrast, the exterior sides 238 of anchors 230A, 230B, project outwardly from interior space 220 and beyond envelope 222 through side openings 226A, 226B, of pile 200, respectively. As shown in FIG. 5, extension portion 239 of each anchor 230A, 230B, that projects outwardly from envelope 222 may have an extension width $W_E$ (measured outwardly from envelope 222). The extension width $W_E$ may be as small as about 0.25 in., 0.5 in., or 1 in., and as large as about 1.5 in., 2 in., 2.5 in., or more, or within any range defined between any pair of the foregoing values.

Anchors 130A, 130B, span across interior space 120 between flanges 110, 112, of the illustrative pile 100, as shown in FIG. 4. Anchors 130A, 130B, may be fixedly coupled to flanges 110, 112, such as using spot welds 140, adhesive, or mechanical fasteners, for example. When upper surfaces 132 of anchors 130A, 130B, or lower surfaces 134 of anchors 130A, 130B, are viewed along longitudinal axis A, as shown in FIG. 4, anchors 130A, 130B, may appear to occupy a majority (i.e., more than 50%) of the area of interior space 120. For example, anchors 130A, 130B, may appear to occupy more than about 60%, 70%, or 80% of the area of interior space 120, or within any range defined between any pair of the foregoing values. Stated differently, a projected area of anchors 130A, 130B, onto a perpendicular plane (i.e., a plane that is perpendicular to longitudinal axis A), as shown in FIG. 4, may comprise a majority of the area of interior space 120.

Anchors 130A, 130B, of the illustrative pile 100 extend transversely (i.e., non-parallel) to longitudinal axis A, as shown in FIG. 3. Anchors 130A, 130B, may be angled downwardly in pile 100 from exterior sides 138 to interior sides 136. In this arrangement, upper surfaces 132 of anchors 130A, 130B, define an acute angle $\alpha$ with longitudinal axis A, and lower surfaces 134 of anchors 130A, 130B, define an obtuse angle $\beta$ with longitudinal axis A. The acute angle $\alpha$ may be as small as about 10 degrees, 20 degrees, 30 degrees, or 40 degrees, and as large as about 50 degrees, 60 degrees, 70 degrees, or 80 degrees, or within any range defined between any pair of the foregoing values. In FIG. 3, the acute angle $\alpha$ is about 30-40 degrees, and the corresponding obtuse angle $\beta$ is about 140-150 degrees. The angles $\alpha$ and $\beta$ may vary depending on the desired application of pile 100 (e.g., the load to be supported by pile 100, the surrounding soil type). Together, the downwardly-angled anchors 130A, 130B, may form a V-shaped body in pile 100. During insertion of pile 100 into the soil S, this V-shaped body may cut into the soil S. After insertion, this V-shaped body may resist removal of pile 100 from the soil S, as discussed further below.

Anchors 130A, 130B, of the illustrative pile 100 are spaced apart from each other and from intermediate web 114 to define at least one intermediate gap, illustratively two intermediate gaps 150A, 150B, between interior sides 136 of anchors 130A, 130B. Gaps 150A, 150B, are located on opposite sides of intermediate web 114. In use, soil S in interior space 120 of pile 100 is able to travel from lower surface 134 to upper surface 132 of anchors 130A, 130B, through gaps 150A, 150B, respectively, as shown in FIG. 2B. In the illustrated embodiment of FIG. 3, each gap 150A, 150B, between intermediate web 114 and interior side 136 of the corresponding anchor 130A, 130B, respectively, may have a gap width $W_G$ as small as about 0.25 in., 0.5 in., or 1 in., and as large as about 1.5 in., 2 in., 2.5 in., or more, or within any range defined between any pair of the foregoing values.

Figure 11:
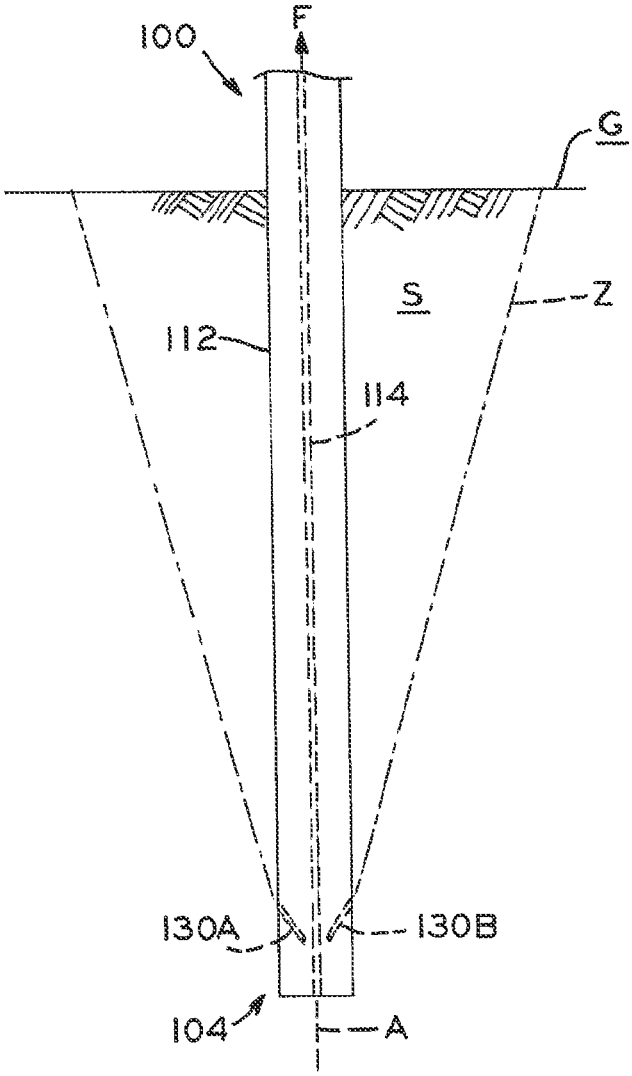
FIG. 11 is an elevational view of the pile of FIG. 1 being subjected to a pull-out force.

After pile 100 is driven into the soil S, anchors 130A, 130B, may increase the pull-out resistance of pile 100 from the soil S. Pile 100 is shown being subjected to a pull-out force F in FIG. 11. Soil S may gather atop upper surfaces 132 of anchors 130A, 130B, and add weight to pile 100, thereby resisting the pull-out force F. Additionally, anchors 130A, 130B, may transfer the pull-out force F outwardly into the soil S beyond pile 100. In the illustrated embodiment of FIG. 11, for example, anchors 130A, 130B, transfer the pull-out force F to a pyramid-shaped zone Z of soil S located outwardly beyond pile 100. Particle-to-particle adhesion between the soil particles in zone Z may further resist the pull-out force F. This particle-to-particle adhesion between the soil particles in zone Z may be more significant than the metal-to-particle adhesion between pile 100 and the surrounding soil S.

Figure 7:
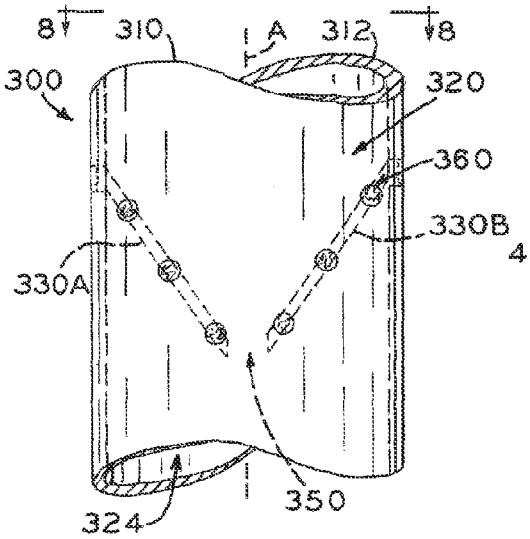
FIG. 7 is an elevational view of a lower portion of yet another exemplary pile of the present disclosure.
Figure 8:
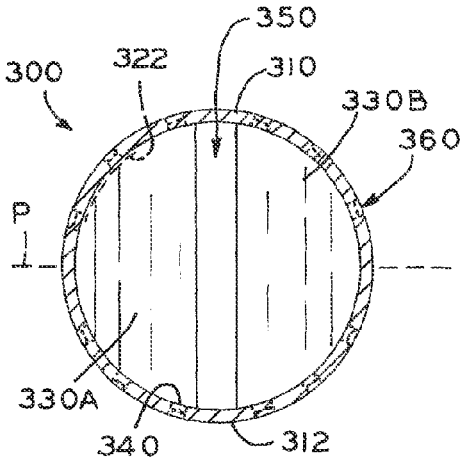
FIG. 8 is a plan cross-sectional view of the pile of FIG. 7, taken along line 8-8 of FIG. 7.

Another exemplary pile 300 is shown in FIGS. 7 and 8. The illustrative pile 300 is a circular tube pile having a circular longitudinal wall (i.e., a cylindrical wall). Although the longitudinal wall of pile 300 is illustratively a single, generally continuous, circular wall, pile 300 is described herein as having a first longitudinal wall 310 located on a first side of longitudinal plane P and a second longitudinal wall 312 located on a second side of longitudinal plane P, where the first and second longitudinal walls 310, 312, are both semicircular in shape and are interconnected. These semicircular walls 310, 312, cooperate to define a circular envelope 322 around interior space 320.

A lower end opening 324 into interior space 320 may be provided to receive soil S in pile 300, as shown in FIG. 7. However, because interior space 320 may be enclosed or surrounded by the first and second longitudinal walls 310, 312, pile 300 may lack side openings into interior space 320 for receipt of additional soil S.

Other than anchors 330A, 330B, the illustrative pile 300 lacks other intermediate structures (e.g., an intermediate web) in interior space 320. Without an intermediate web between anchors 330A, 330B, a single gap 350 may exist between anchors 330A, 330B, and this gap 350 may be aligned with longitudinal axis A.

If necessary, apertures 360 in the first and second longitudinal walls 310, 312, may be provided, at least temporarily, to facilitate assembly of anchors 330A, 330B, in interior space 320 of pile 300. For example, apertures 360 may facilitate receipt of spot welds 340, adhesive, or mechanical fasteners, into interior space 320 of pile 300. However, apertures 360 may be plugged or otherwise blocked after assembly.

Figure 9:
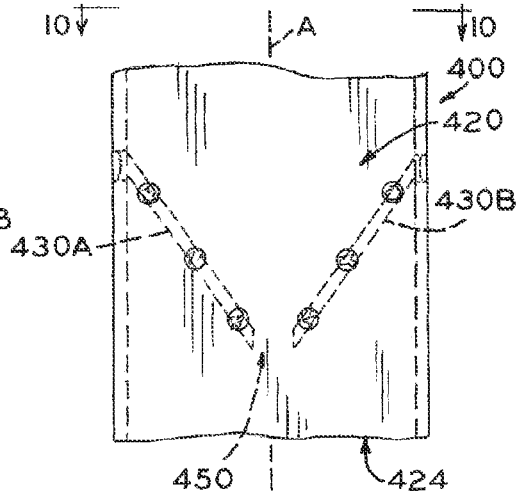
FIG. 9 is an elevational view of a lower portion of still yet another exemplary pile of the present disclosure.
Figure 10:
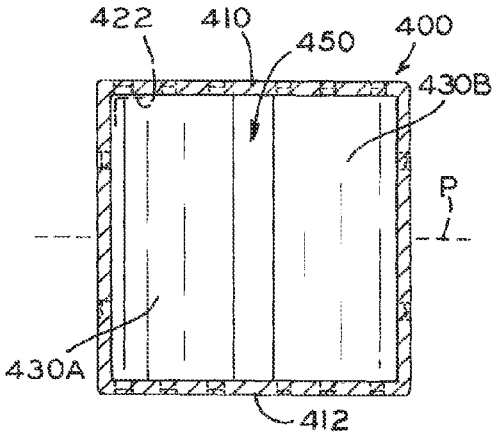
FIG. 10 is a plan cross-sectional view of the pile of FIG. 9, taken along line 10-10 of FIG. 9.

Yet another exemplary pile 400 is shown in FIGS. 9 and 10. The illustrative pile 400 is a box tube pile having a rectangular longitudinal wall. Although the longitudinal wall of pile 400 is illustratively a generally continuous, rectangular wall, pile 400 is described herein as having a first longitudinal wall 410 located on a first side of longitudinal plane P and a second longitudinal wall 412 located on a second side of longitudinal plane P, where the first and second longitudinal walls 410, 412, are both U-shaped and are interconnected. These U-shaped walls 410, 412, cooperate to define a rectangular envelope 422 around interior space 420.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A pile having an upper end, a lower end, and a longitudinal axis that extends between the upper end and the lower end, a longitudinal plane intersecting and extending parallel to the longitudinal axis, the pile comprising:

a first longitudinal wall located on a first side of the longitudinal plane;

a second longitudinal wall located on a second side of the longitudinal plane;

an interior space formed between the first and second longitudinal walls;

at least one anchor located at least partially in the interior space between the first and second longitudinal walls, the at least one anchor extending transversely to the longitudinal axis;

an intermediate web that extends between the first and second longitudinal walls;

wherein the first longitudinal wall, the second longitudinal wall and the intermediate web form an H-shape, whereby the pile comprises an H-pile, the at least one anchor spanning the first longitudinal wall and the second longitudinal wall, the at least one anchor having an at least one anchor interior side and an at least one anchor exterior side located further from the longitudinal axis than the at least one anchor interior side, wherein the at least one anchor angles downwardly relative to the longitudinal axis from the at least one anchor exterior side to the at least one anchor interior side, the at least one anchor interior side spaced from the intermediate web.

2. The pile of claim 1, further comprising at least one side opening into the interior space between the first and second longitudinal walls.

3. The pile of claim 1, wherein the first and second longitudinal walls are interconnected to enclose the interior space.

4. The pile of claim 1, further comprising a second anchor located at least partially in the interior space between the first and second longitudinal walls, the second anchor extending transversely to the longitudinal axis.

5. The pile of claim 4, wherein the second anchor is a mirror image of the at least one anchor.

6. The pile of claim 1, further comprising a second anchor located at least partially in the interior space between the first and second longitudinal walls, the second anchor having a second anchor interior side and a second anchor exterior side located further from the longitudinal axis than the second anchor interior side, wherein the second anchor angles downwardly relative to the longitudinal axis from the second anchor exterior side to the second anchor interior side, the second anchor interior side spaced from the intermediate web.

* * * * *